US005803372A

United States Patent [19]

Weinstein et al.

[11] Patent Number: 5,803,372

[45] Date of Patent: Sep. 8, 1998

[54] HAND HELD ROTARY ATOMIZER SPRAY GUN

[75] Inventors: Richard Weinstein, Toledo, Ohio; David M. Seitz, Temperance, Mich.

[73] Assignee: Asahi Sunac Corporation

[21] Appl. No.: 833,189

[22] Filed: Apr. 3, 1997

[51] Int. Cl.[6] ..... B05B 3/02; B05B 5/04

[52] U.S. Cl. ..... 239/703; 239/223

[58] Field of Search ..... 239/700–703, 239/223, 224; 384/134

[56] References Cited

U.S. PATENT DOCUMENTS

| | | | |
|---|---|---|---|
| D. 283,832 | 5/1986 | Weinstein et al. . | |
| 2,764,712 | 9/1956 | Juvinall . | |
| 2,926,106 | 2/1960 | Gauthier . | |
| 3,021,077 | 2/1962 | Gauthier . | |
| 3,091,289 | 5/1963 | Weinstein . | |
| 3,168,737 | 2/1965 | Weinstein . | |
| 3,196,440 | 7/1965 | Weinstein . | |
| 3,227,837 | 1/1966 | Weinstein . | |
| 3,254,199 | 5/1966 | Weinstein . | |
| 3,261,963 | 7/1966 | Weinstein . | |
| 3,334,645 | 8/1967 | Weinstein . | |
| 3,359,911 | 12/1967 | Weinstein . | |
| 3,387,622 | 6/1968 | Weinstein . | |
| 3,711,060 | 1/1973 | Weinstein . | |
| 3,792,409 | 2/1974 | Smart et al. . | |
| 4,165,022 | 8/1979 | Bentley et al. . | |
| 4,331,298 | 5/1982 | Bentley et al. . | |
| 4,402,303 | 9/1983 | Koenneman . | |
| 4,406,468 | 9/1983 | Gimple et al. . | |
| 4,457,695 | 7/1984 | Kümmel | 239/224 X |
| 4,520,949 | 6/1985 | Seitz et al. . | |
| 4,555,058 | 11/1985 | Weinstein et al. . | |
| 4,572,437 | 2/1986 | Huber et al. | 239/223 X |
| 4,650,123 | 3/1987 | Ooishi | 239/223 X |
| 4,657,184 | 4/1987 | Weinstein . | |
| 4,750,676 | 6/1988 | Huber et al. . | |
| 4,811,906 | 3/1989 | Prus . | |
| 4,896,834 | 1/1990 | Coeling et al. . | |
| 4,899,936 | 2/1990 | Weinstein . | |
| 4,919,333 | 4/1990 | Weinstein . | |
| 4,928,883 | 5/1990 | Weinstein . | |
| 4,934,603 | 6/1990 | Lasley . | |
| 4,934,607 | 6/1990 | Lasley . | |
| 4,936,507 | 6/1990 | Weinstein . | |

(List continued on next page.)

OTHER PUBLICATIONS

*DeVilbiss Ransburg No. 2 Process Hand Gun Spray Techniques* ITW Ransburg, Form IL–211 Brochure.

*ITW Ransburg No. 2 Process* Electrostatic Hand Gun, Form IL–8843, 1995 ITW Ransburg Electrostatic Systems.

*ITW Ransburg Electrostatic Systems No. 2 Process Handgun Applications,* Form IL–8900, ITW Ransburg, 1996.

*Primary Examiner*—Kevin Weldon

*Attorney, Agent, or Firm*—Emch, Schaffer, Schaub & Porcello, Co., L.P.A.

[57] ABSTRACT

An improved hand held rotary atomizer spray gun is disclosed. The spray gun includes a housing with a depending handle. A paint tube within the housing delivers paint to a rotatable bell atomizer which is mounted adjacent the front of the gun. A turbine assembly includes a turbine rotor which drives a turbine shaft which mounts the bell atomizer. The turbine shaft is supported by a bearing air chamber. A turbine air passageway and a bearing air passageway supply turbine air to the turbine rotor and bearing air to the bearing air chamber. When a trigger is squeezed paint is supplied to the atomizer bell while turbine air rotates the turbine shaft and the bell atomizer. An air shuttle assembly prevents air flow to the turbine unless sufficient bearing air is flowing to the bearing air chamber. In a preferred embodiment shaping air is supplied to shaping air openings in a housing air cap and the atomizer bell includes serrations on its inner edge. The shaping air directs the atomized paint particles toward the target. A supplemental crossover passageway provides shaping air to the turbine to maintain proper turbine speed during initial delivery of paint to the atomizing bell. In another embodiment, a high voltage ladder is mounted within the handle and its outlet internally charges the paint to a high voltage. In this embodiment electrostatic forces and mechanical forces are used to atomize the paint particles.

16 Claims, 6 Drawing Sheets

U.S. PATENT DOCUMENTS

| | | | |
|---|---|---|---|
| 4,936,509 | 6/1990 | Weinstein . | |
| 4,936,510 | 6/1990 | Weinstein . | |
| 4,943,005 | 7/1990 | Weinstein . | |
| 4,943,178 | 7/1990 | Weinstein . | |
| 4,997,130 | 3/1991 | Weinstein . | |
| 5,039,019 | 8/1991 | Weinstein et al. . | |
| 5,222,664 | 6/1993 | Noakes et al. . | |
| 5,236,129 | 8/1993 | Grime et al. . | |
| 5,324,547 | 6/1994 | Ohhashi et al. . | |
| 5,358,182 | 10/1994 | Cappeau et al. | 239/224 X |
| 5,397,063 | 3/1995 | Weinstein . | |
| 5,433,387 | 7/1995 | Howe et al. . | |

HAND HELD ROTARY ATOMIZER SPRAY GUN

BACKGROUND OF THE INVENTION

The present invention is directed to an improved hand held rotary atomizer spray gun. This improved type of spray gun uses centrifugal forces of a rotating bell to atomize paint and low pressure air to direct atomized paint particles toward a target. Electrostatic charging may be used to assist in attracting fine atomized particles to the target. This is as opposed to prior art hand held conventional compressed air spray guns which use pressurized air to break up and atomize a stream of paint and hydraulic hand spray guns which use highly pressurized fluid that atomizes as it enters atmospheric pressure through a small orifice. Electrostatic attraction also can be used as an assist to these spray guns.

Hand held electrostatic rotary atomizer spray guns are also known in the art. An early disclosure of such a spray gun is shown in U.S. Pat. No. 3,021,077.

A commercial prior art rotary atomizer spray gun is sold by ITW Ransburg as the "No. 2 Process" electrostatic hand gun. This type of gun uses a bell with a large outer surface rotating at a low speed (~900 RPM) which causes a thin low viscosity fluid to move to the bell outer surface where primarily electrostatic forces cause internal repulsion of the thinly sheeted fluid such that the fluid which is attracted to a grounded target surface breaks free of the bell surface into small atomized droplets which attach themselves to the grounded target.

Automatic high speed (10,000–60,000 RPM) rotary atomizers with electrostatic charging have been developed for industrial use. These rotary atomizers are held by a structure rather than by an operator. These devices are useful for automatic reciprocation or robotic movement in an industrial environment such as automotive finishing. These devices are generally large, heavy, have high gyroscopic forces, use high volumes of pressurized air to shape (shaping air) and drive the centrifugally radially propulsed atomized particles in a useful direction toward a grounded target. Generally the additional movement of paint booth air helps to remove fine particles of charged overspray paint which escape the shaping air containment and would normally coat the grounded rear surfaces of the atomizer as well as any grounded booth hardware in the vicinity of the atomizer.

The present invention is directed to a hand held rotary atomizer which overcomes the problems of the prior art devices and specifically offers improvements needed when an atomizer is taken from an automatically programmed environment and placed in the hands of a human being.

SUMMARY OF THE INVENTION

The present invention is directed to a hand held rotary atomizer spray gun which has a handle mounted adjacent the rear end of a longitudinally extending housing. A paint supply tube is mounted within the housing and has a discharge nozzle at its distal end. A turbine assembly is mounted within the housing and includes a rotatable shaft. An atomizing bell is mounted at the end of the rotatable shaft. The atomizing bell defines an opening for receiving the discharge nozzle of the paint supply tube.

The housing and the turbine shaft define a generally tubular bearing space for receiving bearing air, whereby the turbine shaft is supported by said bearing air during rotation of the turbine shaft. In an electrostatic embodiment, a voltage ladder assembly for supplying high voltage to the paint within the paint supply tube is mounted within the handle and is operatively connected to the paint within the paint supply tube. A bearing air passageway for supplying bearing air to the bearing space is included within the housing together with a turbine air passageway for supplying turbine air to the turbine assembly for rotating the turbine shaft and the atomizing bell. An air shuttle assembly, for stopping the turbine air when the bearing air supply is closed and opening the turbine air supply when the bearing air is open is located within the housing.

DESCRIPTION OF THE PREFERRED EMBODIMENT

Figure 2:
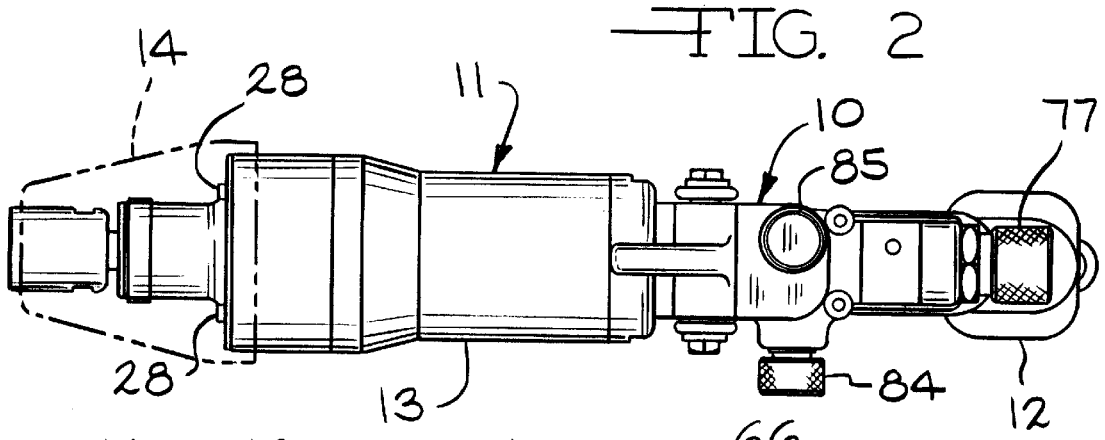
FIG. 2 is a top view of the hand held rotary atomizer spray gun shown in FIG. 1 and showing the shaping air cap portion of the housing in dashed lines.

Referring to the drawings, a hand held rotary atomizer spray gun, according to the present invention, is generally indicated by the reference number 10. The spray gun 10 includes a housing 11 and a depending handle 12. The housing 11 has a longitudinally extending central barrel 13 which is connected to the handle 12 and a front shaping air cap 14. The shaping air cap 14 is attached to the central barrel 13 of the housing 11. Preferably, the air cap 14 and the central barrel 13 of the housing 11 is constructed from an electrically non-conductive plastic while the handle 12 is constructed from an electrically conductive plastic.

Figure 3A:
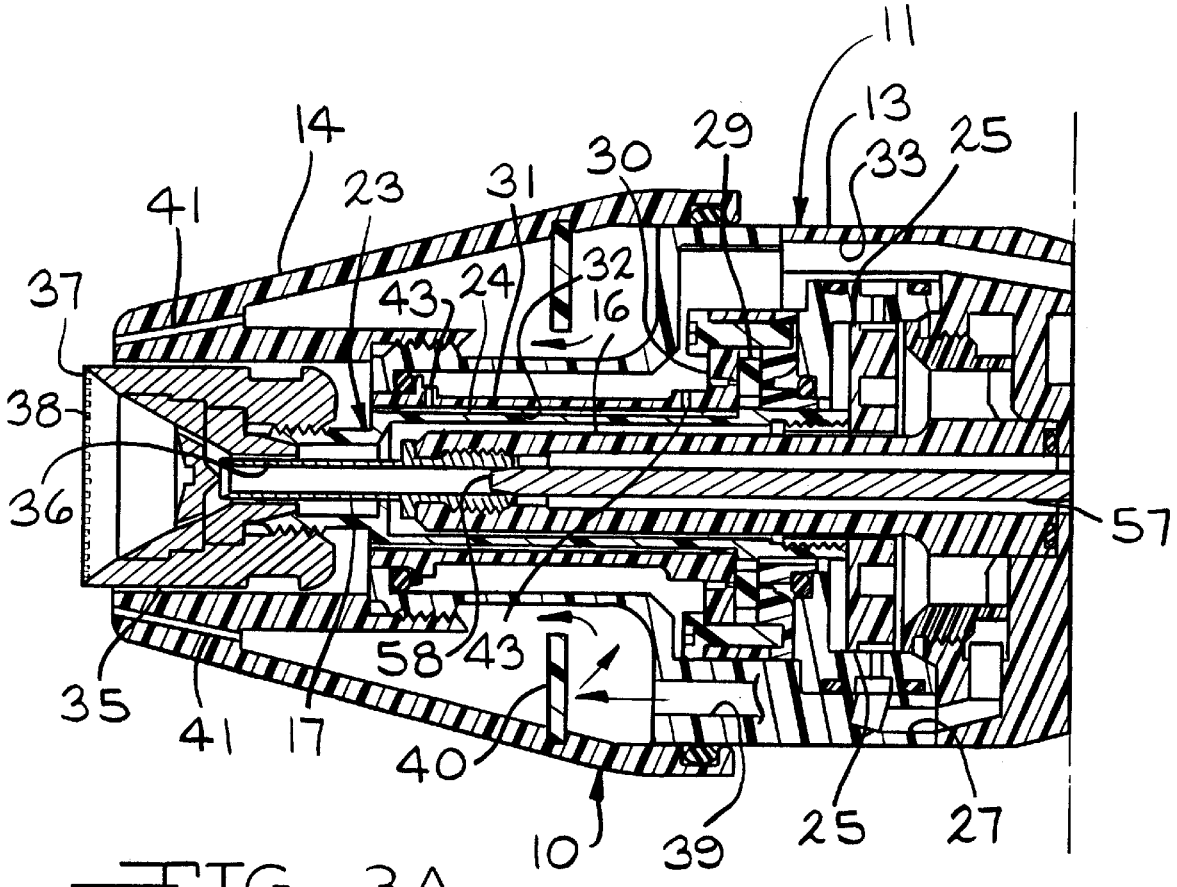
FIG. 3A is a cross-sectional view of the front portion of the hand held rotary atomizer spray gun shown in FIGS. 1 and 2.

Referring to FIG. 3A, a longitudinally extending paint supply tube 16 is mounted within the housing 11. The fluid tube 16 has a fluid nozzle 17 mounted at its front end.

Figure 3B:
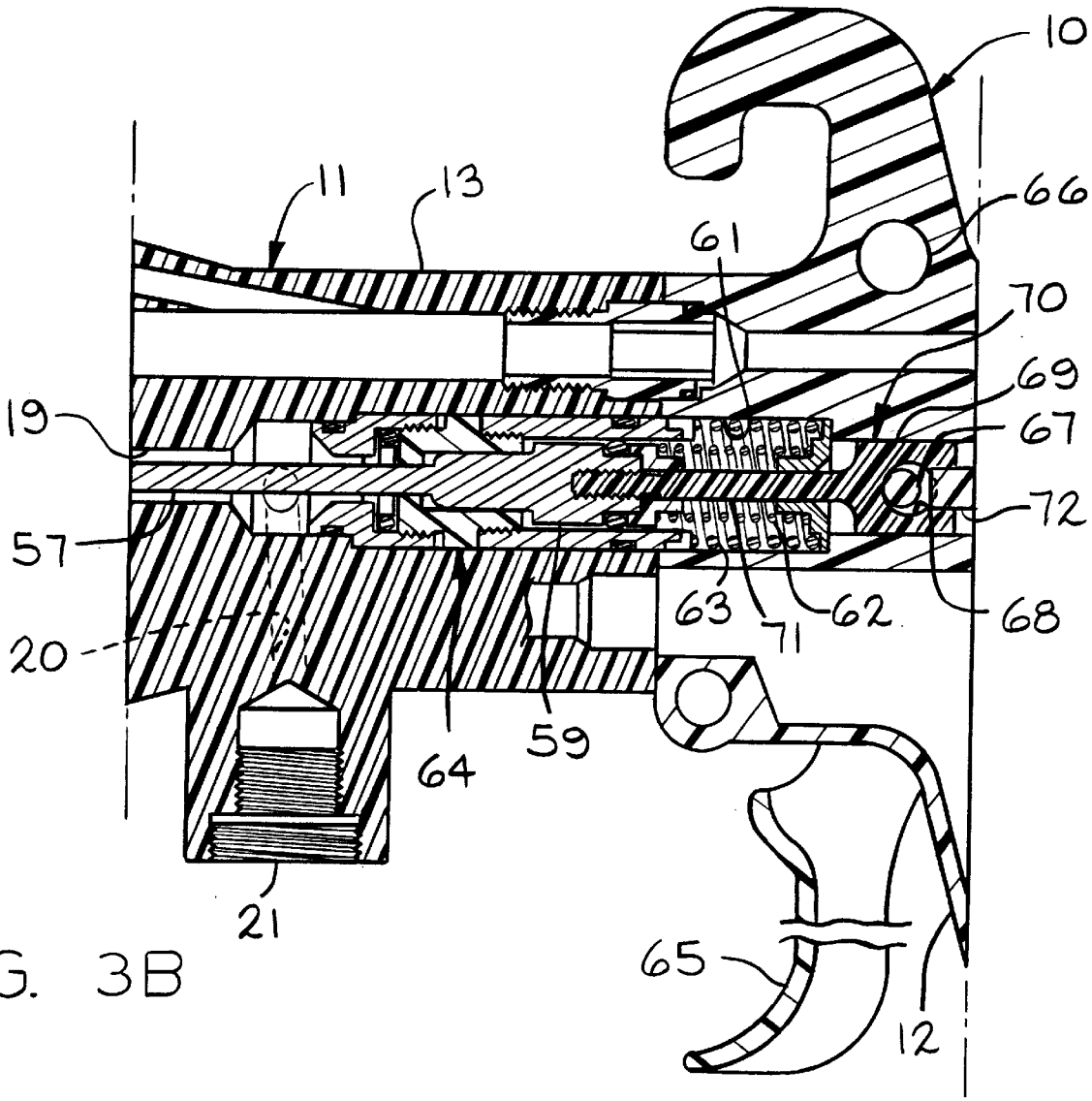
FIG. 3B is a view similar to FIG. 3A, showing the middle portion of the hand held rotary atomizer spray gun.

Referring to FIG. 3B, the barrel 13 of the housing 11 defines a center passageway 19 which is connected by a paint passage 20 to a paint inlet 21.

Figure 1:
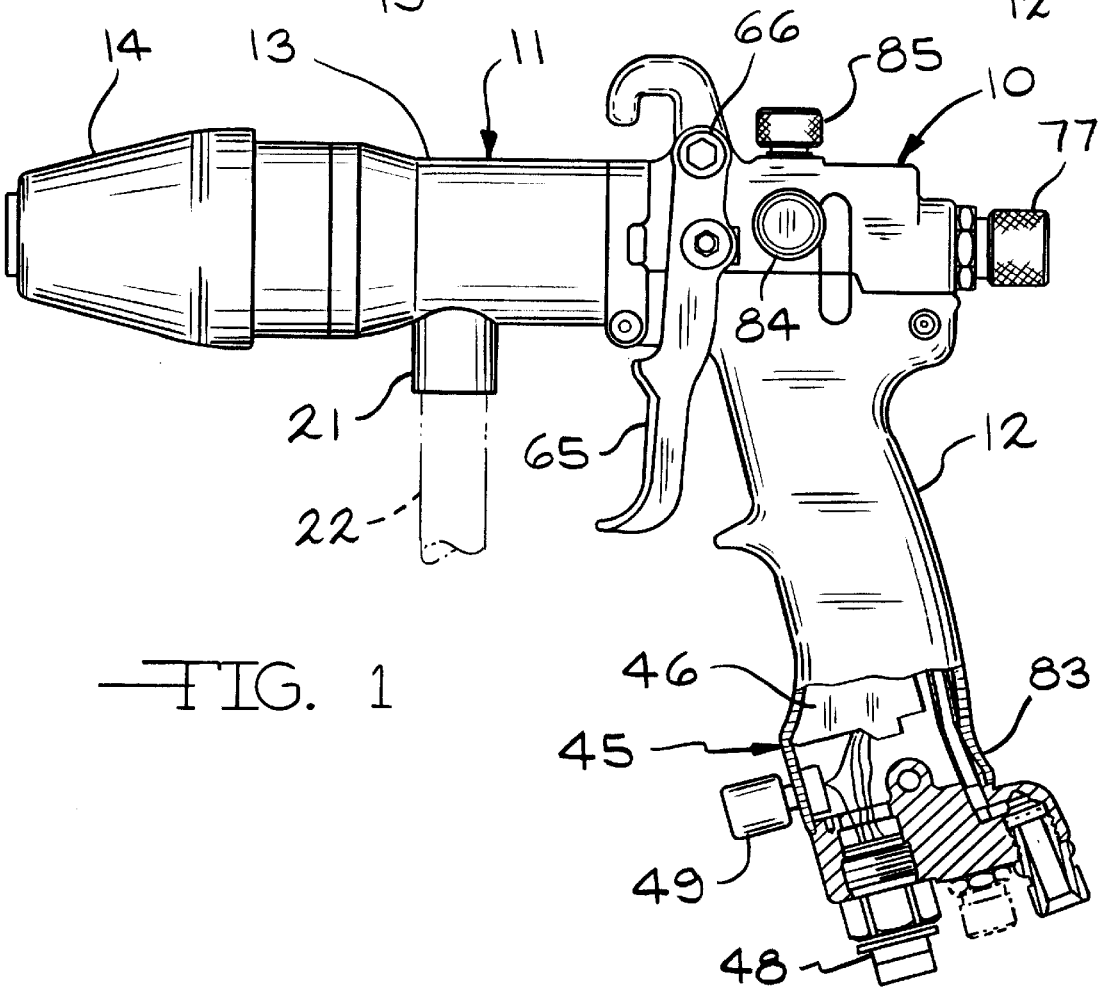
FIG. 1 is a side elevational view, partially in cross section, showing a hand held rotary atomizer spray gun, according to the present invention.

Referring to FIG. 1, a hose 22 delivers paint to the paint inlet 21. The paint then travels through the paint passage 20 and the center passageway 19. The paint is then directed through the fluid tube 16 to the fluid nozzle 17.

A turbine assembly 23 is mounted within the barrel 13 of the housing 11. The turbine assembly 23 includes a rotatable hollow center shaft 24 which mounts a turbine rotor 25. It is preferable that the turbine rotor have a diameter which does not exceed two inches (5.1 cm). By removing the air cap 14 and a plurality of screws 28 (see FIG. 2) the entire turbine assembly 23 can be removed from the housing 11. The fluid tube 16 extends through the hollow-center of the turbine shaft 24. Turbine air is supplied through a turbine air passageway 26 to a turbine air discharge 27 to drive the turbine rotor 25 and the turbine shaft 24. In the present embodiment, a flange 29 extends outwardly from the turbine shaft 24 and is received by a housing thrust bearing assembly 30. The housing 11 defines a longitudinally extending cylindrical bearing wall 31 which receives the rotatable turbine shaft 24. The housing bearing wall 31 and the turbine shaft 24 have a cylindrical bearing space 32 defined therebetween which receives bearing air from a bearing air passageway 33. The cylindrical bearing space 32 is also referred to as an air bearing. Because the turbine shaft 24 is rotating at high speeds, often in a range of between 7,500 rpm and 50,000 rpm, it is important that a proper bearing be provided. It has been found that the air bearing assembly, according to the present invention, provides an improved bearing assembly for a rotary hand gun. It is not unusual for a hand gun, after use, and disconnection from the power supply, be cleaned in a container of solvent. In prior art bearing assemblies, which rely upon oil lubricated bearings, the solvent tends to destroy the oil bearing lubricant resulting in damage to the hand gun when it is placed back in operation.

An atomizing bell 35, which defines a central opening 36 is threadably attached to the distal end of the turbine shaft 24. The bell 35 rotates with the turbine shaft 24. The atomizing bell 35 includes an inner surface 37. The inner surface 37 includes a plurality of serrations 38 adjacent the forward end of the atomizing bell 35. The serrations 38 are parallel to the axis of rotation of the atomizing bell 35. It has been found that the serrations 38, because of the relatively small diameter and low edge speed of the atomizing bell 35, aids in atomizing the paint particles by separating the paint into thin rivulets which atomize into fine particles even at the low edge speeds. This provides improved mechanical atomizing forces. In the present embodiment, the atomizing bell 35 is constructed of multiple parts, however, in other embodiments (not shown) the atomizing bell 35 has an integral one-piece construction. The atomizing bell can be constructed of either plastic or metal. The atomizing bell has a diameter at its forward edge of less than one and one-half inches (3.8 cm) and preferably one-inch (2.5 cm) or less. As shown in FIG. 3A, the end of the fluid nozzle 17 extends through the central opening 36 of the atomizing bell 35. As the atomizing bell 35 rotates, paint is discharged through the fluid nozzle 17 onto the interior of the atomizing bell 35. The rotation of the atomizing bell 35 moves the paint in a thin layer outwardly to the serrations 38 of the inner surface 37 where the paint is atomized.

It has been found that a rotary spray gun, according to the present invention, which has a serrated rotary bell of a diameter of one inch or less and a relatively slow speed of 10,000 rpm or less, surprisingly atomizes the paint particles. Shaping air, preferably of under 5 scfm, moves the paint particles to the target without the use of additional forces, such as electrostatic forces, compressed air forces or high pressure paint forces. Unexpectedly the paint as it leaves the rotary bell atomizer with low volume shaping air moves softly to the target while maintaining a relatively small diameter pattern of under 4 inches (10.2 cm) at the target. This is very helpful in painting interior corners and holes where the use of electrostatic forces sometimes creates problems as the charged paint particles move toward the closest grounded surface.

In other situations, when electrostatic force is used, the paint is charged internally within the gun, using high voltages. It has been found that the internal charging of the paint is superior to external charging methods especially in a hand held gun because the absence of an external electrode prevents the creation of electrostatic fields which cause charged paint particles to coat all grounded surfaces in the vicinity of the gun including the operator.

Referring to FIG. 3A, the housing 11 defines a shaping air passageway 39 which discharges shaping air against a circular baffle 40 which is mounted within the interior of the shaping air cap 14. The shaping air cap 14 defines a plurality of circumferentially spaced shaping air openings 41 which direct shaping air in a generally cylindrical path against the atomized paint particles being discharged radially from the serrated front edge 37 of the atomizing bell 35.

This shapes the particle stream into a forward direction and tends to retard stray paint particles from moving outwardly and rearwardly toward the remainder of the spray gun 10 and the operator. It has been found that the shaping air, emanating from the shaping air openings 41, urges the atomized paint particles toward the target. As noted above, the shaping air is preferably under 5 scfm.

As shown in FIG. 3A, the tubular housing bearing wall 31 defines a plurality of bearing openings 43 which receive bearing air from the bearing air passageway 33 and directs it into the bearing air space 32 located between the housing bearing wall 31 and the turbine shaft 24.

Figure 3C:
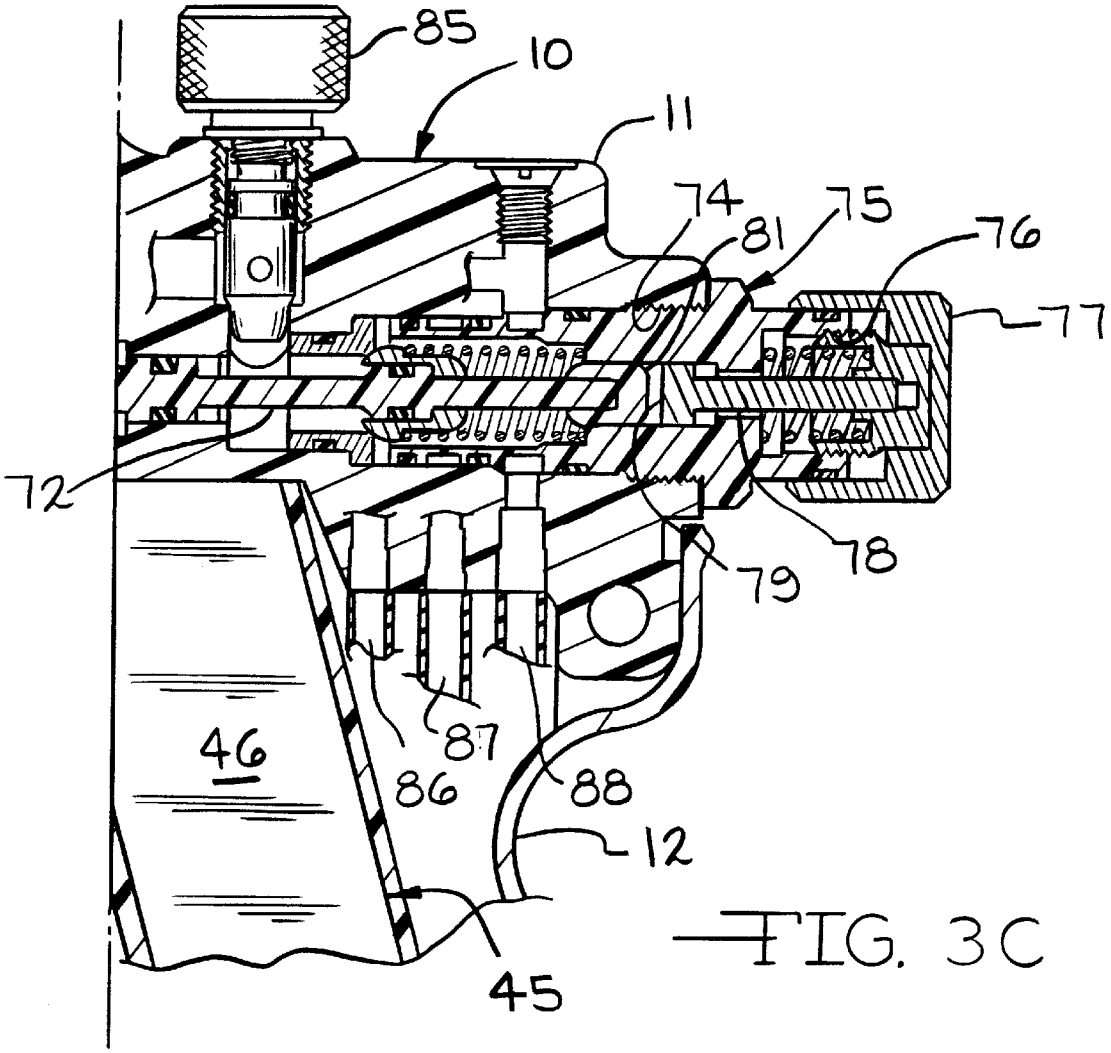
FIG. 3C is a view similar to FIGS. 3A and 3B showing the rear portion of the hand held rotary atomizer spray gun.
Figure 4:
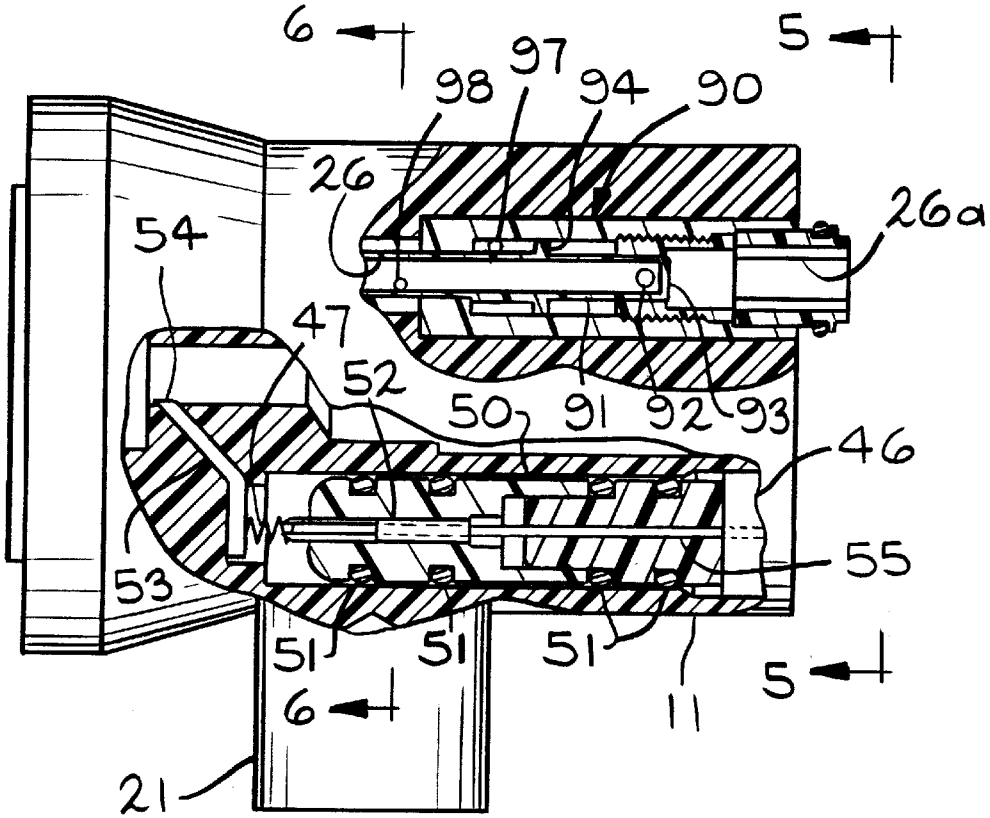
FIG. 4 is a side elevational view of the middle portion of the hand held rotary atomizer spray gun and showing in cross section details of the shuttle valve assembly and an electrical power supply.

Referring to FIGS. 1, 3C and 4, a power supply assembly 45 includes a potted high voltage ladder 46 mounted within the handle 12 and terminates at a contact spring 47. The power supply assembly 45 including the high voltage ladder 46 is a prior art power supply sold by Asahi Sunac, the assignee of the present invention. The power supply assembly 45 includes an electrical input fitting 48 and a high voltage on-off switch 49. The voltage ladder 46 through a tubular output assembly 50 is in electrical communication with the contact spring 47. High voltage seals 51 are mounted on the tubular output assembly 50 and the housing 11. The power supply assembly 45 includes an electrical outlet wire 55 which extends from the high voltage ladder 46 to a resistor assembly 52. The resistor assembly 52 is in electrical communication with the contact spring 47 which is electrically connected to a charging wire 53 having a charging end 54 positioned in electrical contact with the paint flowing to the fluid tube 16. Therefore, the charging end 54 charges the paint internally with respect to the rotary atomizer spray gun 10.

The electrical input 48 is normally connected to a low voltage input of between 12 and 40 volts. The electrical output from the power supply assembly 45 to the charging wire 53 is normally between 40,000 volts and 100,000 volts DC.

Referring to FIGS. 3A and 3B, a valve needle 57 having a front end 58 and an enlarged rear end 59 is mounted within the center passageway 19 of the fluid tube 16. The valve needle 57 is reciprocally mounted and its front end 58 is seated in the fluid nozzle 17, when in its closed position. When the front end 58 of the valve needle 57 is in the forward closed position, paint supply to the fluid nozzle 17 and the atomizing bell 35 is stopped. When the front end 58 of the valve needle 57 is moved rearwardly, paint flows through the fluid tube 16 and through the fluid nozzle 17 to the rotating atomizing bell 35.

Referring to FIG. 3B, the handle 12 defines a spring chamber 61 which receives an inner coil spring 62 and an outer coil spring 63. The inner spring 62 urges the valve needle 57 toward its closed position. A trigger 65 is pivotally mounted by a pivot pin 66 mounted by the handle 12. The inner spring 62 also urges the trigger away from the handle 12. The outer spring 63 holds a seal assembly 64 in position. The trigger 65 includes an operating pin 67 which is received in a circular bore 68 defined by an enlarged section 69 of an operating assembly 70. The operating assembly 70 includes a forward operating rod 71 which is attached to the rear end 59 of the valve needle 57 and a rear operating rod 72.

Referring to FIG. 3C, the handle 12 defines a threaded bore 74 at the rear end of the spray gun 10. A tubular assembly 75 is attached to the bore 74. Internal threads 76 are provided at the rear end of the tubular assembly 75. An adjustment cap 77 having an inwardly directed plunger 78 is connected to the rear end of the tubular assembly 75. The plunger 78 has an inner end surface 79. An end cap 81 is mounted on the rear end of the rear operating rod 72 and is positioned in a defined spaced relationship to the inner end surface 79 of the plunger 78. Rotation of the adjustment cap 77 moves the plunger 78 and its inner end surface 79 inwardly or outwardly to define the rearward travel of the operating rod 72 and hence the position of front end 58 of the valve needle 57. The adjustment cap 77 adjusts the closed position and the maximum opening position of the valve needle 57 and the paint flow, upon the movement of the trigger 65.

Referring to FIG. 3B, as the trigger 65 is squeezed, the operating pin 67 connected to the trigger 65 is moved rearwardly to engage the rearward operating rod 72 and move the front end 58 of the valve needle 57 away from its seat.

Referring to FIG. 1, a plurality of conduits 83 supply turbine air, shaping air and bearing air to the handle 12 of the hand held rotary atomizer spray gun 10. The conduits 83 include a shaping air conduit 86, a turbine air conduit 87 and a bearing air conduit 88 (see FIG. 3C). The bearing air is normally controlled at a remote operating panel and is operating continuously. The shaping air is directed through the shaping air passage 39 and to the shaping air openings 41. The shaping air is controlled by a shaping air control 85. The turbine air is controlled by a turbine speed control 84 and is directed to the turbine air passageway 26 and to the turbine rotor 25.

As mentioned above, the fact that the turbine shaft 24 is supported by the air bearing or bearing air space 32 is an important feature of the present invention. It is also important that the bearing air be turned on prior to actuation of the turbine assembly 23. Because of the high speed of rotation of the turbine shaft 24, if bearing air is not provided to the bearing air space 32 prior to rotation of the turbine rotor 25, there is a high risk of damage to the bearing wall 31 and the turbine shaft 24.

To lessen this possibility, referring to FIG. 4, an air shuttle assembly 90 is provided. The shuttle assembly 90 is in direct communication and controls the movement of turbine air through the turbine air passageway 26. Referring to FIG. 4, the shuttle air assembly 90 includes a moveable turbine air valve 91 having a turbine air opening 92 adjacent its rearward end. The valve 91 includes an end 93 which prevents turbine air from entering the valve 91 when the valve 91 is in the left or closed position, as shown in FIG. 4. A piston ring 94 is mounted on the exterior of the valve 91. Upon startup, turbine air is received in the turbine air passageway 26(*a*). The valve 91 is moved to its closed or left position (as shown in FIG. 4) and turbine air cannot enter the turbine air passageway 26 to the turbine assembly 23.

Figure 5:
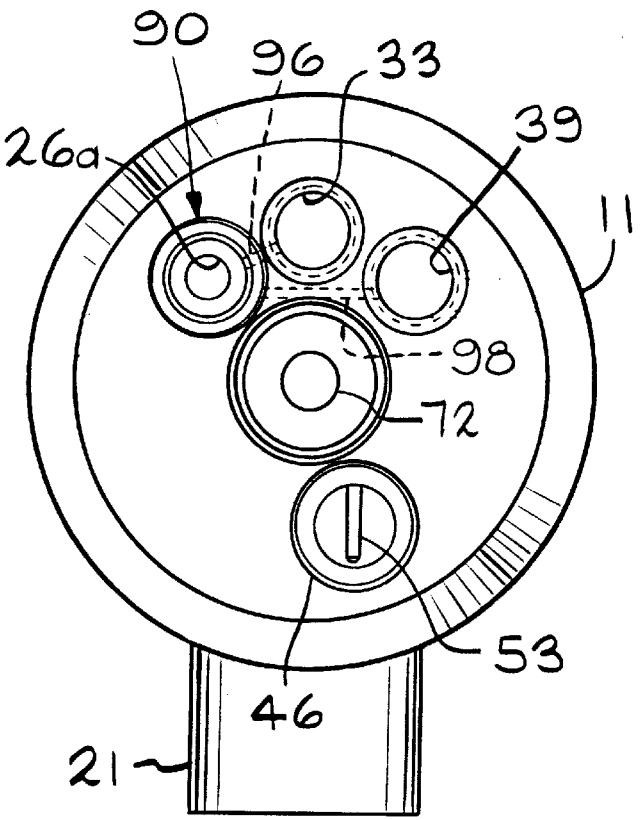
FIG. 5 is a cross-sectional view taken along the line 5—5 of FIG. 4.

Referring to FIG. 5, the bearing air passageway 33 is connected to the air shuttle assembly 90 by a crossover passageway 96 extending between the bearing air passageway 33 and the shuttle assembly 90. When the bearing air is activated, bearing air travels from the bearing air passageway 33 through the crossover passageway 96 to an opening 97 behind the piston ring 94 to move the shuttle valve 91 to the right or open position. When this occurs, turbine air from the turbine air passageway 26(*a*) passes through the turbine air opening 92 of the shuttle valve 91 into the remaining portion of the turbine passageway 26 leading to the turbine assembly 23.

In addition to insuring that the bearing air be on prior to forwarding turbine air to the turbine assembly 23, the shuttle assembly 90 regulates turbine over speed and the speed of the atomizing bell 35. For example, if the atomizing bell 35 is designed to operate at a maximum speed of 40,000 rpm, if the turbine air in the turbine air passageway 26(*a*) reaches a predetermined pressure whereby the atomizing bell speed would exceed the 40,000 rpm design limit, the pressure in the turbine air passageway 26(*a*) urges the shuttle valve 91 of the air shuttle assembly 90 to the left against the bearing air pressure received from the bearing air crossover passageway 96 to move the turbine air valve 91 to the left toward its restricted or closed position, as shown in FIG. 4. If turbine pressure becomes excessively high it causes the shuttle to constrict so as to choke off the turbine operation. It would then be necessary for the operator to adjust the turbine air supply to reduce the turbine air pressure to the correct level to prevent overspeeding of the turbine.

Referring to FIG. 5, a second crossover passageway 98 is provided between the shaping air passageway 39 and the turbine air passageway 26. The second shaping air crossover passageway 98 is provided to give the turbine rotor 25 and the turbine shaft 24 a boost to help maintain bell speed as the paint initially contacts the atomizing bell 35. It has been found that during the initial startup of the painting operation, even though the atomizing bell 35 is rotating at the desired rpm, the initial application of paint to the interior of the atomizing bell 35 reduces the speed of the bell 35 sufficiently that it effects the atomization of the paint particles thereby varying the atomized particles which effects the desired quality of the paint at the target.

Figure 6:
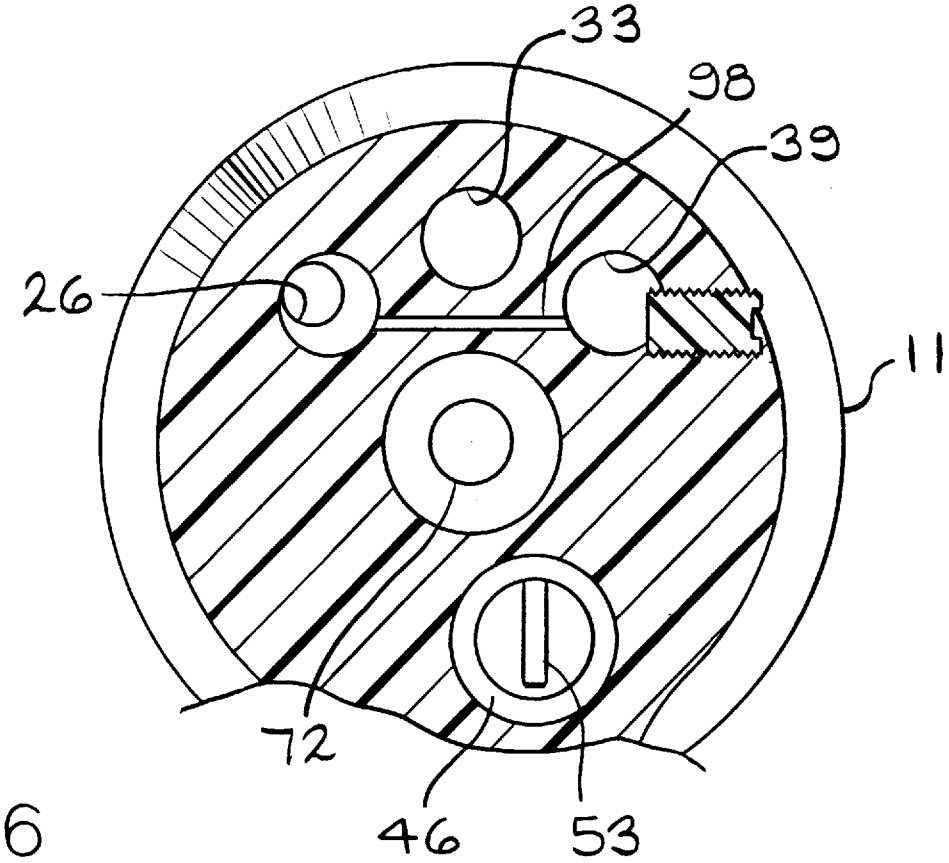
FIG. 6 is a cross-sectional view taken along the line 6—6 of FIG. 4.

Referring to the drawings, in a first operation of the hand held rotary atomizer spray gun 10, according to the present invention, a target, such as a car body is positioned in a painting position. The operator grasps the spray gun 10 and points it toward the target. The control panel supplies air to the plurality of conduits 83. There is no separate controller for the bearing air which is automatically directed from a panel to the spray gun 10. The bearing air operates the air shuttle assembly 90 moving the rod valve 91 to the open position, whereby turbine air is supplied to the turbine assembly 23, thereby beginning the rotation of the atomizing bell 35. As the trigger 65 is squeezed, it activates the shaping air and provides the shaping air to the shaping air openings 41 adjacent the serrated edge 37 of the atomizing bell 35. Shaping air also passes through the supplemental second crossover passageway 98 (FIGS. 5 and 6) thereby supplying additional or supplemental air to the turbine assembly 23 as paint is initially supplied to the atomizing bell 35. Concurrent squeezing of the trigger 65 moves the valve needle 57 to its open position allowing the paint to be discharged through the fluid nozzle 17 directly into the interior of the atomizing bell 35. The operator is able to adjust the shaping air by using the shaping air control 85 and the turbine speed by adjusting the turbine speed control 84. The paint is then mechanically atomized and discharged from the serrated inner edge 37 of the atomizing bell 35 where it is directed toward and is deposited on the target.

In the event that the turbine air pressure is too high, the rod valve 91 of the air shuttle assembly 90 is moved toward the closed position, thereby preventing the turbine from overspeeding and alerting the operator to adjust the turbine air pressure.

In a second operation of the hand held rotary atomizer spray gun 10, according to the present invention, the target is grounded.

The control panel supplies air to the plurality of conduits 83 and the operator turns on the electrical switch 49 to supply power to the high voltage ladder 46.

The end 54 of the charging wire 53 internally places a high voltage charge to the paint which is discharged through the fluid nozzle 17 directly into the atomizing bell 35. The paint flows in a thin layer along the inner rotating surface of the atomizing bell 35.

The serrations 38 at the edge of the bell 35 separates the paint into thin rivulets which are atomized into finely charged particles by the mechanical centrifugal forces and the electrostatic forces.

The charged paint is discharged from the bell radially. The cylindrical layer of shaping air shapes the particle stream in a forward direction. The paint particles are then transported to the target and electrostatically deposited.

Many revisions may be made to the above-described embodiment without departing from the scope of the following claims.

We claim:

1. A hand held rotary atomizer spray gun comprising, a housing having a front end and a rear end, a handle mounted adjacent said rear end of said housing, a paint supply tube mounted within said housing, said paint supply tube having a discharge nozzle at one end, a turbine assembly mounted within said housing, said turbine assembly including a rotatable shaft, an atomizing bell mounted on said rotatable shaft, said atomizing bell defining an opening for receiving said discharge nozzle of said paint supply tube, said turbine shaft mounting a turbine rotor, said housing and said turbine shaft defining a generally tubular bearing space for receiving bearing air, whereby said turbine shaft is supported by said bearing air during rotation of said turbine shaft, a bearing air passageway for supplying bearing air to said bearing space and a turbine air passageway for supplying turbine air to said turbine rotor for rotating said turbine shaft and said atomizing bell and an air shuttle assembly for stopping said turbine air when said bearing air supply is closed and opening said turbine air supply when said bearing air supply is open.

2. A hand held rotary atomizer spray gun, according to claim 1, wherein said atomizer bell has an inner edge surface and a plurality of serrations defined on the forward portion of said inner edge surface.

3. A hand held rotary atomizer spray gun, according to claim 2, wherein said atomizer bell has a diameter of one inch (2.5 cm) or less.

4. A hand held rotary atomizer spray gun, according to claim 1, including a needle valve assembly mounted within said paint supply tube for opening and closing the supply of paint to said fluid tube and to said atomizing bell.

5. A hand held rotary atomizer spray gun, according to claim 2, including a trigger pivotally mounted adjacent said handle and operatively connected to said needle assembly, whereby said needle assembly is moved to open said supply of paint when said trigger is squeezed.

6. A hand held rotary atomizer spray gun, according to claim 5, including a spring return operatively connected to said needle assembly for urging said needle assembly to the closed position when said trigger is released.

7. A hand held rotary atomizer spray gun, according to claim 1, said air shuttle assembly including a movable shuttle valve mounted within said turbine air passageway, said shuttle valve being movable between a first position wherein said turbine passageway is closed and a second position wherein said turbine passageway is open and a crossover passageway between said bearing air passageway and said shuttle assembly, whereby bearing air through said crossover passageway urges said shuttle valve toward said second position whereby said turbine passageway is open to supply turbine air to said turbine rotor.

8. A hand held rotary atomizer spray gun, according to claim 1, wherein said housing includes a shaping air cap defining a plurality of circumferentially spaced shaping air openings surrounding said bell atomizer, a shaping air passageway for supplying shaping air to said shaping air openings, a supplemental passageway between said shaping air passageway and said turbine air passageway whereby shaping air is combined with turbine air and directed to the turbine rotor when paint is initially delivered to said bell atomizer.

9. A hand held electrostatic rotary atomizer spray gun comprising, a housing having a front end and a rear end, a handle mounted adjacent said rear end of said housing, a paint supply tube mounted within said housing, said paint supply tube having a discharge nozzle at one end, a turbine assembly mounted within said housing, said turbine assembly including a rotatable shaft, an atomizing bell mounted on said rotatable shaft, said atomizing bell defining an opening for receiving said discharge nozzle of said paint supply tube, said turbine shaft mounting a turbine rotor, said atomizer bell having an inner edge surface, a plurality of serrations defined on the forward portion of said inner edge surface, said housing and said turbine shaft defining a generally tubular bearing space for receiving bearing air, whereby said turbine shaft is supported by said bearing air during rotation of said turbine shaft, a voltage ladder assembly for supplying high voltage internally to paint within said paint supply tube, a bearing air passageway for supplying bearing air to said bearing space and a turbine air passageway for supplying turbine air to said turbine rotor for rotating said turbine shaft and said atomizing bell and an air shuttle assembly for stopping said turbine air when said bearing air supply is closed and opening said turbine air supply when said bearing air supply is open.

10. A hand held electrostatic rotary atomizer spray gun, according to claim 9, wherein said atomizer bell has a diameter of one inch (2.5 cm) or less.

11. A hand held electrostatic rotary atomizer spray gun, according to claim 9, including a needle valve assembly mounted within said paint supply tube for opening and closing the supply of paint to said fluid tube and to said atomizing bell.

12. A hand held electrostatic rotary atomizer spray gun, according to claim 11, including a trigger pivotally mounted adjacent said handle and operatively connected to said needle assembly, whereby said needle assembly is moved to open said supply of paint when said trigger is squeezed.

13. A hand held electrostatic rotary atomizer spray gun, according to claim 12, including a spring return operatively connected to said needle assembly for urging said needle assembly to the closed position when said trigger is released.

14. A hand held electrostatic rotary atomizer spray gun, according to claim 9, whereby said voltage ladder assembly is mounted within said handle.

15. A hand held electrostatic rotary atomizer spray gun, according to claim 9, said air shuttle assembly including a movable shuttle valve mounted within said turbine air passageway, said shuttle valve being movable between a first position wherein said turbine passageway is closed and a second position wherein said turbine passageway is open and a crossover passageway between said bearing air passageway and said shuttle assembly, whereby bearing air through said crossover passageway urges said shuttle valve toward said second position whereby said turbine passageway is open to supply turbine air to said turbine rotor.

16. A hand held electrostatic rotary atomizer spray gun, according to claim 9, wherein said housing includes a shaping air cap defining a plurality of circumferentially spaced shaping air openings surrounding said bell atomizer, a shaping air passageway for supplying shaping air to said shaping air openings, a supplemental passageway between said shaping air passageway and said turbine air passageway whereby shaping air is combined with turbine air and directed to the turbine rotor when paint is initially delivered to said bell atomizer.

* * * * *